United States Patent [19]

Truce

[11] Patent Number: 4,746,331

[45] Date of Patent: May 24, 1988

[54] DETECTING, MEASURING AND APPLYING BACK CORONA PARAMETERS ON AN ELECTROSTATIC PRECIPITATOR

[76] Inventor: Rodney J. Truce, 29 Douglas Street, Sherwood, Queensland, 4075, Australia

[21] Appl. No.: 872,908

[22] Filed: Jun. 11, 1986

Related U.S. Application Data

[63] Continuation of Ser. No. 766,339, Aug. 16, 1985, abandoned, which is a continuation of Ser. No. 479,070, Mar. 21, 1983, abandoned.

[30] Foreign Application Priority Data

Jul. 24, 1981 [AU] Australia ..... PE9888

[51] Int. Cl.[4] ..... B03C 3/68

[52] U.S. Cl. ..... 55/4; 55/2; 55/12; 55/105; 55/134

[58] Field of Search ..... 55/2, 4, 104, 105, 12, 55/134

[56] References Cited

U.S. PATENT DOCUMENTS

| | | | |
|---|---|---|---|
| 2,704,134 | 3/1955 | White | 55/4 |
| 2,864,456 | 12/1958 | Hall et al. | 55/105 |
| 2,925,142 | 2/1960 | Wasserman . | |
| 2,961,577 | 11/1960 | Thomas et al. | 55/105 |
| 3,488,675 | 1/1970 | Eishold | 55/2 |
| 3,577,705 | 5/1971 | Sharlit | 55/4 |
| 3,745,749 | 7/1973 | Gelfand | 55/105 |
| 3,873,282 | 3/1975 | Finch . | |
| 3,893,828 | 7/1975 | Archer | 55/104 |
| 4,233,037 | 11/1980 | Pontius et al. | 55/2 |
| 4,239,505 | 12/1980 | Drnevich | 55/4 X |
| 4,267,502 | 5/1981 | Reese et al. . | |
| 4,311,491 | 1/1982 | Bibbo et al. | 55/2 |
| 4,318,152 | 3/1982 | Weber | 55/104 X |
| 4,382,805 | 5/1983 | Herklotz et al. | 55/2 |
| 4,433,281 | 2/1984 | Herklotz et al. | 55/105 X |
| 4,445,911 | 5/1984 | Lind | 55/105 X |

FOREIGN PATENT DOCUMENTS

| | | |
|---|---|---|
| 55525 | 7/1982 | European Pat. Off. . |
| 705604 | 3/1954 | United Kingdom . |
| 726556 | 3/1955 | United Kingdom . |
| 756760 | 12/1956 | United Kingdom . |
| 812277 | 4/1959 | United Kingdom . |
| 956783 | 4/1964 | United Kingdom . |

OTHER PUBLICATIONS

Bohm, I. J., "Back Discharge in Electrostatic Gas Cleaning", Staub-Reinhalt Luft, vol. 30, No. 3, Mar. 1970, pp. 1-11.

"Symposium on the Transfer and Utilization of Particulate Control Technology: vol. 1, Electrostatic Precipitators", U.S. Environmental Protection Agency, Bulletin EPA-60017-79-044a, Feb. 1979, pp. 381-394.

"Back Corona and its Effects on the Optimisation of Electrical Precipitator Energisation Control", by Rodney John Truce, 7th Annual International Clean Air Conference, Adelaide, Australia, Aug. 24-28, 1981.

Second CSIRO Conference on Electrostatic Precipitation, Aug. 1983, "The Optimum Control of Electrostatic Precipitators Under Back Corona Conditions", by Rodney John Truce.

*Primary Examiner*—Kathleen J. Prunner

*Attorney, Agent, or Firm*—Foley & Lardner, Schwartz, Jeffery, Schwaab, Mack, Blumenthal & Evans

[57] ABSTRACT

The invention relates to the detection of the presence of back corona in an electrostatic precipitator, the measurement of parameters associated with back corona and the control of the electrostatic precipitator system and associated plant. The parameters detected provide indication of the sensitivity of the precipitator and dust to back corona formation, the severity of back corona occuring within the precipitator, the efficiency of the dust collection process and the level of dust build-up on the electrodes within the precipitator. These parameters may be displayed to the operator and used in controlling precipitator systems and associated plant.

10 Claims, 2 Drawing Sheets

DETECTING, MEASURING AND APPLYING BACK CORONA PARAMETERS ON AN ELECTROSTATIC PRECIPITATOR

This application is a continuation of Ser. No. 766,339, filed Aug. 16, 1985, which is a continuation of Ser. No. 479,070, filed Mar. 21, 1983; which is a national filing of international application No. PCT/Au 82/00116, filed July 23, 1982, which claims priority of Australian application No. PE 9888, both abandoned.

BACKGROUND OF THE INVENTION

This invention relates to a method of detecting back corona in electrostatic precipitators, measuring parameters, which indicate back corona susceptibility, precipitation performance and electrode contamination, and determine the back corona current and conductivity in order to control the precipitator and associated plant to limit back corona.

An electrostatic precipitator is a device which uses electricity to collect dust particles suspended in a gas. The device consists of two sets of electrodes, one of which is energised from a high voltage electricity supply while the second is earthed. The gas-particle mixture is passed between the two electrodes. The particles are charged by ions created by a corona about the energised, emitter electrode. The particles are then attracted to the collector electrode by the electric field.

Each precipitator may have one or more electrical zones, each energized from a single high voltage supply. Each electrical zone normally has many emitter electrodes connected in parallel and many collector electrodes connected to earth by the precipitator frame. This may result in an extremely large and expensive device.

The emitter electrodes are energised using a power control unit and a transformer to provide the high voltage necessary. FIG. 1 depicts a schematic diagram of a typical electrostatic precipitator energisation system. The power control unit regulates the primary A.C. input to the transformer using a silicon controlled rectifier phase angle controller or a magnetic amplifier. The high voltage transfromer input is adjusted by varying the control unit output using a reference or setpoint signal. Adjustment of the control unit reference signal will cause both the emitter voltage and emitter current to change. The emitter voltage level signal and emitter current level signal are available, or can be obtained using voltage divider resistor networks, for each electrical section of the precipitator.

As the control unit reference signal is increased from zero, the emitter voltage increases but the emitter current remains at zero. At a certain emitter voltage, termed the "Emitter Corona Onset Voltage", the emitter current commences. Further increases in the control unit reference signal will cause the emitter current to increase. The emitter voltage may increase or decrease depending on the precipitator conditions and energisation level. FIGS. 2A-2C depict the emitter voltage waveform and emitter current waveform for low, medium and high energisation, or control unit reference signal, levels on a typical precipitator with 50 Hz. A.C. energisation. The emitter current is a pulsed waveform, coincident with increasing emitter voltage, while the emitter voltage has an A.C. component superimposed on a D.C. level.

Back corona is the term used to describe the gaseous breakdown which occurs in the collected dust layer. The breakdown is a result of intense electric fields created in the collected dust by the conduction of charge through the highly resistive dust. The collection efficiency of the electrostatic precipitator is reduced by the presence of back corona. The detection and limitation of back corona is important when highly resistive dusts, such as Queensland coal fly ash, are being collected in an electrostatic precipitator.

As the energisation level of the electrostatic precipitator is increased, the precipitation of particles improves due to the higher inter-electrode electric fields and particle charge. Once sufficient charge flow exists for back corona to form, the detrimental effects caused by back corona will restrict the improvement attained from increasing energisation. The back corona effects, increasing rapidly with energisation, will cause a reduction in the electrostatic precipitator's collection efficiency. A maximum efficiency will occur at or just above the back corona formation energisation level.

In order to prevent back corona, gases are introduced into the precipitator intake gas before it reaches the precipitator. The use of substances, such as Sulphurtrioxide, Ammonia or Steam, to improve precipitator performance by reducing or eliminating back corona has been practiced for some time. Since the cost of some of the substances used is high, the operating cost of the precipitator can increase dramatically if the addition of the conditioning agent is not regulated properly.

SUMMARY OF THE INVENTION

It is the object of the present invention to detect the presence of back corona in an electrostatic precipitator by monitoring the "Minimum Secondary Voltage".

According to the present invention, this problem is solved by monitoring the minimum level of the A.C. emitter voltage, termed the "Minimum Secondary Voltage". Back corona is detected if, for an increase in energisation, the "Minimum Secondary Voltage" decreases or remains constant or if, for a constant energisation, the "Minimum Secondary Voltage" decreases.

In this manner the presence of back corona may be detected at normal operating energisation or during an increase in energisation. The detection of back corona would indicate a cause for reduced precipitator efficiency and is therefore of great significance.

A preferred object of the present invention is to measure important parameters at the minimum energisation level at which back corona can be detected. Parameters to be measured include "Effective Back Corona Onset Voltage", "Effective back Corona Onset Current" and "Effective Back Corona Onset Minimum Voltage".

This problem is solved by lowering or raising the energisation, depending on the presence of back corona at the current operating energisation, until, using the process previously described for the detection of back corona, the lowest energisation level at which back corona can be detected is found.

In this manner parameters which give an indication of the following may be measured:

(a) Precipitator or dust sensitivity to back corona—"Effective Back Corona Onset Current"

(b) Precipitator performance—"Effective Back Corona Onset Voltage"

(c) Emitter electrode contamination—"Effective Back Corona Onset Minimum Voltage"

These parameters provide important data which can be used by operators or control systems to ensure optimum precipitator operation.

An additional preferred object of the present invention is to determine important parameters associated with back corona at the normal energisation.

Parameters to be obtained include "Effective Back Corona Current", "Effective Back Corona Conductivity" and "Effective Precipitator Conductivity".

This problem is solved by using calculations involving the "Effective Back Corona Onset Current", the "Effective Back Corona Onset Voltage", the "Emitter Corona Onset Voltage", the present average emitter voltage and the present average emitter current.

In this manner the parameters which give an indication of the following present operating conditions may be measured:

(a) Severity of back corona—"Effective Back Corona Current"

(b) Collector electrode contamination—"Effective Precipitator Conductivity"

These parameters provide continuous information on the operation of the precipitator. This information may be used by operators or control systems.

DETAILED DESCRIPTION

Figure 1:
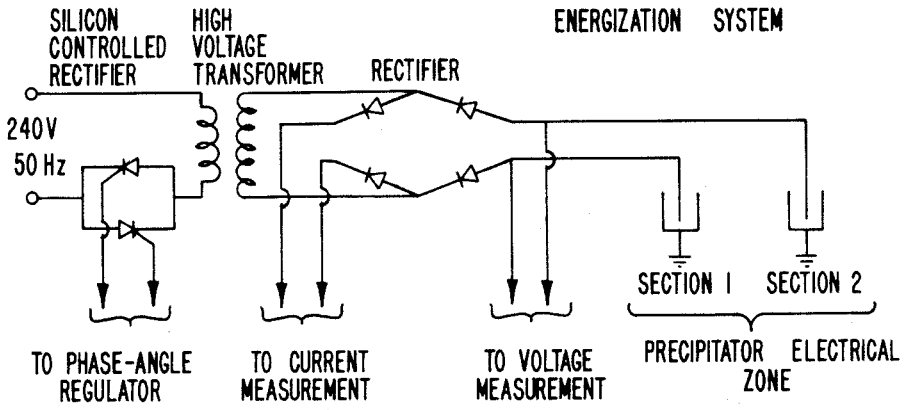
FIG. 1 PRIOR ART
FIG. 1 depicts a schematic diagram of a typical prior art electrostatic precipitator energization system.
Figure 2A:
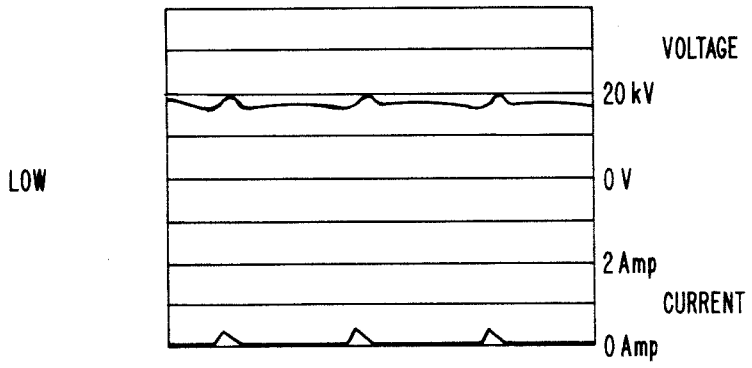
FIG. 2a PRIOR ART
FIGS. 2A–2C depict the emitter voltage waveform and emitter current waveforms for low, medium and high energization levels of the device depicted in FIG. 1.
Figure 2B:
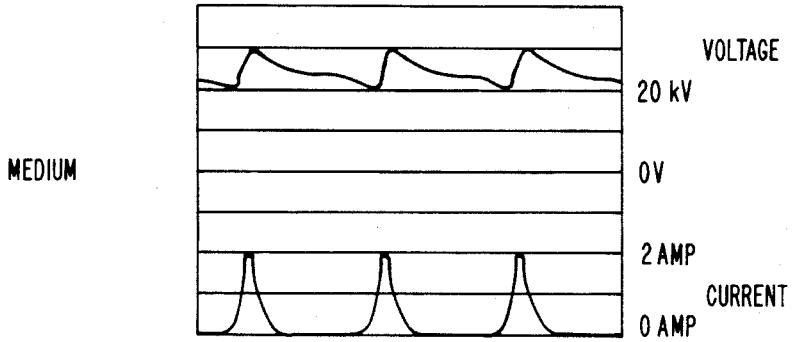
FIG. 2b PRIOR ART
Figure 2C:
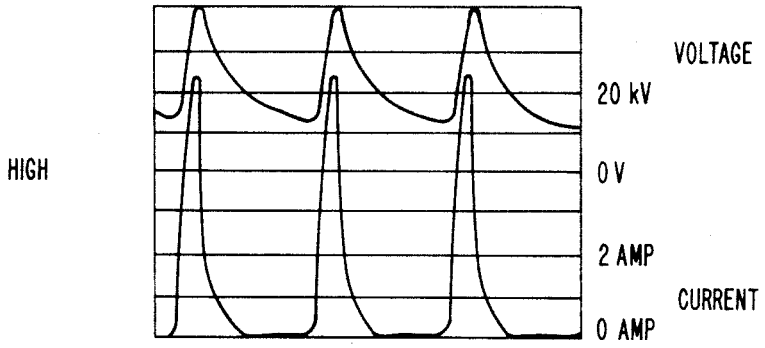
FIG. 2c PRIOR ART

The object of the invention is to detect the formation of back corona by measuring the emitter electrode electric current and voltage. The voltage at the emitter electrode is a D.C. level with a superimposed waveform. To detect the onset of back corona, the minimum voltage level of the AC component must be measured. This value is called the "Minimum Secondary Voltage". Three possible measurement techniques are:

(a) Using an analogue peak detection and measurement circuit.

(b) Using a computer system to monitor the voltage level and determine the minimum level.

(c) Measurement of the voltage level immediately prior to energising the emitter electrode using a silicon controlled rectifier.

Back corona is detected if the "Minimum Secondary Voltage" decreases when the precipitator energisation is increased or held constant. The point at which a small change in electrostatic precipitator energisation results in no change in "Minimum Secondary Voltage" is termed the "Effective Back Corona Onset Point". This point may be determined by using an electronic system to control the electrostatic precipitator energisation and monitor the "Minimum Secondary Voltage". The control system could use two techniques to determine the "Effective Back Corona Onset Point":

(a) Slowly increase or decrease the energisation and test for zero rate of change of the "Minimum Secondary Voltage".

(b) Slowly increase or decrease the energisation until a maximum level of "Minimum Secondary Voltage" is found.

Since the "Minimum Secondary Voltage" increases with energisation below the "Back Corona Onset Point" and decreases as the energisation is increased beyond this point, either of the methods described may be used to determine the "Back Corona Onset Point". The "Back Corona Onset Point" is an indication of the energisation level at which back corona forms.

A prefered object of the invention is to measure relevant parameters associated with the back corona detection.

The average emitter current measured at the "Effective Back Corona Onset Point" is termed the "Effective Back Corona Onset Current". This parameter is an indication of the dust and the electrostatic precipitator susceptibility to back corona. A lower "Effective Back Corona Onset Current" indicates a higher susceptibility to back corona.

The average emitter voltage measured at the "Effective Back Corona Onset Point" is termed the "Effective Back Corona Onset Voltage". This parameter is an indication of the electrostatic precipitator performance. A higher "Effective Back Corona Onset Voltage" indicates higher electrostatic precipitator performance. By monitoring the "Effective Back Corona Onset Current" and the "Effective Back Corona Onset Voltage" an indication of the performance and back corona susceptibility is available.

The "Minimum Secondary Voltage" measured at the "Effective Back Corona Onset Point" is termed the "Effective Back Corona Onset Minimum Voltage". By monitoring this voltage an indication of the emitter contamination or dust build-up is provided. Increasing "Effective Back Corona Onset Minimum Voltage" indicates an increase in emitter contamination.

An additional preferred object of this invention is to determine a signal which is an indication of back corona current and a signal which is an indication of back corona conductivity. The signals which are determined are termed "Effective Back Corona Current" and "Effective Back Corona Conductivity" respectively. In order to determine these parameters it is necessary to determine the "Emitter Corona Onset Voltage", the "Effective Back Corona Onset Voltage" and the "Effective Back Corona Onset Current" by reducing the energisation level, or increasing the energisation level from zero, until these points are detected, as described previously.

The average level of the emitter voltage and the average level of the emitter current must be measured at the operating energisation level. Two possible measurement techniques are:

(a) Using an analogue averaging circuit.

(b) Using a computer system to sample the signals a sufficient number of times, more than five samples per A.C. energisation cycle would be required, and average the sampled values over a time period equal to an integer number of A.C. energisation cycles.

The "Effective Back Corona Current" is determined by implementing the following equation:

$$I_B = I_E - K(V_E - V_O)V_E$$

where:

$I_B$="Effective Back Corona Current"

$I_E$=measured average emitter current $V_O$="Emitter Corona Onset Voltage"

$V_E$=Measured average emitter voltage

The value of the constant K is determined by implementing the following equation:

$$K = \frac{I_{EBO}}{(V_{EBO} - V_O)\, V_{EBO}}$$

where:

$I_{EBO}$="Effective Back Corona Onset Current"

$V_{EBO}$="Effective Back Corona Onset Voltage"

The "Effective Back Corona Current" is an indication of the severity of the back corona present in the precipitator. The higher the "Effective Back Corona Current", the more severe the back corona condition. As back corona is a prime cause for deteriorating precipitator efficiency, the "Effective Back Corona Current" signal would be used to ensure the energisation control was below the back corona severity at which precipitator efficiency deteriorates.

The "Effective Back Corona Conductivity" is determined by implementing the following equation:

$$C_B = I_B / V_E$$

where: $C_B$="Effective Back Corona Conductivity".

The "Effective Precipitator Conductivity" is determined by implementing the following equation:

$$C_{EP} = (I_E - I_B) / V_E$$

where: $C_{EP}$="Effective Precipitator Conductivity".

The "Effective Precipitator Conductivity" provides an indication of collector electrode contamination or dust build-up. An increase in the rate of change of "Effective Precipitator Conductivity" with changing emitter voltage indicates an increase in collector plate build-up. An additional preferred object of this invention is to provide indication of precipitator conditions to the operator and to provide signals to precipitator and associated plant control systems. The control systems, which could use the signals derive by the method described above, include the precipitator energisation controller, the precipitator electrode cleaning system and gas conditioning unit control systems. The implementation of the method described, or part thereof, may be included in one or more of the above control systems or be an independent measurement system.

The energisation control unit could use the "Effective Back Corona Current" signal. The energisation level would be adjusted until the desired level of "Effective Back Corona Current" was attained. Alternatively the energisation control unit could use the "Effective Back Corona Onset Current" as a reference point and adjust the energisation level until the emitter current was the desired amount above or below this reference point.

The electrode cleaning systems are operated at set intervals of time with, in some cases, a variable intensity. By monitoring the change in electrode contamination, using the methods previously described, the cleaning period and intensity can be adjusted to ensure excessive contamination does not occur and cleaning is not excessive.

Gas conditioning apparatus is used to improve the dust resistivity by injecting chemicals into the gas-particle mixture. The prime objective of this is to eliminate back corona. By monitoring the "Effective Back Corona Current" for a constant energization level or by monitoring the "Effective Back Corona Onset Current", the amount of chemical injected may be restricted to that necessary to achieve the back corona reduction desired. The volume of conditioning agent would be adjusted automatically until the desired "Effective Back Corona Current" or "Effective Back Corona Onset Current" was achieved. The conditioning agent could be injected when back corona is detected at the operating energisation level or when the "Effective Back Corona Current" rises above a desired level.

The detection methods, described previously, could be implemented by an analogue electronic system but, in practice, a microcomputer would be used to carry out the required measurements. Inputs to the microcomputer would include emitter voltage signal, emitter current signal, maximum emitter voltage, "Minimum Secondary Voltage" and maximum emitter current. The last three signals would be obtained, from the emitter voltage and emitter current signals, using analogue peak detectors or microcomputer sampling techniques, as described previously. The microcomputer would have an output signal which would allow the energisation level to be varied.

The parameters measured would be available to the operator via an indicator, display or printer. The microcomputer could be used to carry out other functions, such as energisation control, electrode cleaning control or conditioning control, in addition to the measurements described in this invention. The back corona detection system could be incorporated as a part of the appropriate control system, possibly an existing microcomputer, and may not require any additiional equipment.

The claims defining the invention are as follows:

1. A method for detecting back corona in an operating electrostatic precipitator which is energized by a control unit that allows an energization level to be varied, said method comprising the steps of:

monitoring a minimum voltage level of an AC component of an emitter or high tension voltage in order to detect at least one of a constant level or decrease in said minimum voltage level during an increase in said energization level, and a decrease in said minimum voltage level when said energization level remains constant; and detecting the presence of back corona based on said monitoring of said minimum voltage level.

2. A method according to claim 1, further comprising the step of measuring parameters including, "Effective Back Corona Onset Current" and "Effective Back Corona Onset Voltage" when back corona is detected.

3. A method according to claim 2, further comprising the step of determining an "Effective Back Corona Current" parameter using the measured "Effective Back Corona Onset Current" and the "Effective Back Corona Onset Voltage".

4. A method according to claim 3, further comprising the step of determining an "Effective Back Corona Conductivity" parameter using the determined "Effective Back Corona Current".

5. A method according to claim 4, further comprising the step of determining an "Effective Precipitator Conductivity" parameter using the determined "Effective Back Corona Current".

6. A method according to claim 5, further comprising the step of adjusting the cleaning period and intensity of an electrode cleaning system based on the "Effective Precipitator Conductivity" which is an indicator of electrode contamination.

7. A method according to claim 5, further comprising the step of controlling the level of precipitator energization, the period and intensity of electrode cleaning and the level of gas conditioning, using at least one of the measured and determined parameters.

8. A method according to claim 5, further comprising the step of indicating at least one precipitator condition, including precipitator sensitivity to back corona, back corona severity, and electrode contamination using at least one of the measured and determined parameters.

9. A method according to claim 3, further comprising the step of controlling the energization level based on at least one of the "Effective Back Corona Current" and the "Effective Back Corona Onset Current".

10. A method according to claim 3, further comprising controlling the amount of chemicals injected to improve dust resistivity based on at least one of the "Effective Back Corona Onset Current" and the "Effective Back Corona Onset Current".

* * * * *